US005593324A

United States Patent [19]

Ito

[11] Patent Number: 5,593,324

[45] Date of Patent: Jan. 14, 1997

[54] ELECTRIC BULB SOCKET

[75] Inventor: Katsuya Ito, Mie Pref., Japan

[73] Assignee: Sumitomo Wiring Systems, Ltd., Yokkaichi, Japan

[21] Appl. No.: 362,854

[22] Filed: Dec. 23, 1994

[30] Foreign Application Priority Data

Dec. 27, 1993 [JP] Japan ..... 5-350074

[51] Int. Cl.[6] ..... H07R 13/625

[52] U.S. Cl. ..... 439/672; 439/336

[58] Field of Search ..... 439/672, 670, 439/671, 673, 674, 335, 336, 700, 667, 824

[56] References Cited

U.S. PATENT DOCUMENTS

| | | | |
|---|---|---|---|
| 1,594,734 | 8/1926 | Jacobi | 439/672 |
| 1,638,691 | 4/1926 | Hofstetter | 439/666 |
| 3,387,255 | 6/1968 | Earleywine, Jr. | 439/672 |
| 4,099,820 | 7/1978 | DeLano | 439/336 |
| 5,087,213 | 2/1992 | Drapcho et al. | 439/672 |
| 5,154,628 | 10/1992 | Skegin | 439/336 |

FOREIGN PATENT DOCUMENTS

| | | |
|---|---|---|
| 40444/68 | 1/1970 | Australia . |
| 2188913 | 1/1974 | France . |
| 53-53749 | 10/1976 | Japan . |
| 53-53748 | 10/1976 | Japan . |
| 1177332 | 1/1970 | United Kingdom . |

*Primary Examiner*—Gary F. Paumen
*Assistant Examiner*—T. C. Patel
*Attorney, Agent, or Firm*—Wenderoth, Lind & Ponack

[57] ABSTRACT

An electric bulb socket to which an electric bulb having an electrode on the bottom of its cylindrical base is attached includes a cylindrical socket housing having an open end through which the base of the electric bulb is inserted there into and a bottom. A spring support is accommodated in the socket housing so as to face the bottom of the base of the electric bulb, the spring support having an electric supply side electrode abutting against the electrode of the electric bulb. A coil spring is mounted in the socket housing so as to be located outside the spring support for urging the spring support so that it is raised toward the open end of the socket housing. The coil spring is disposed so as to be in parallel with the base of the electric bulb inserted into the socket housing. The length of the socket housing required for accommodating the coil spring can be reduced.

5 Claims, 7 Drawing Sheets

Prior Art

ELECTRIC BULB SOCKET

BACKGROUND OF THE INVENTION

1. Field of the Invention

This invention relates to an electric bulb socket mounted on a wall of a lamp house and more particularly to such a bulb socket to which an electric bulb having an electrode on the bottom of a cylindrical base thereof is attached.

2. Description of the Prior Art

FIG. 8 illustrates a prior art electric bulb B and a prior art socket for the bulb B. The electric bulb B comprises a bulb section m and a base n. The base n has side electrode o formed on its side and a bottom electrode p formed on its bottom. The electric bulb socket comprises a cylindrical housing a having on the outer peripheral wall thereof a mounting portion b at which the socket is mounted on a panel P of a lamp house. A closure c closes one of two ends of the socket housing. The base n of the electric bulb B is inserted into the socket housing a through its other open end, and thus, the open end side of the socket housing a serves as a socket section. Two generally J-shaped slots (not shown) each beginning at the open end of the socket housing a are formed in the inner peripheral wall of the socket section. Two mounting protrusions q of the electric bulb B are inserted into and engaged with the respective J-shaped slots such that the electric bulb B is attached to the bulb socket. When the electric bulb B has been attached to the bulb socket, the side electrode o provided on the side of the base n is connected to a side terminal (not shown) which is connected to an electric supply line W. Furthermore, the bottom electrode p is brought into contact with a bottom terminal e provided on an insulating bottom plate f and connected to the electric supply line W. The bottom plate f is urged by a coil spring d whose one end is held on the closure c. The bottom terminal e is pressed against the bottom electrode p against an urging force exerted by the coil spring d when the electric bulb B has been attached to the bulb socket, whereby the bottom terminal e is brought into contact with the bottom electrode p.

In the electric bulb socket of the above-described type, the socket housing a needs to have a length corresponding to the sum of the length of the base n which is inserted into the socket housing a and the length of the coil spring d disposed in series with the base n in the socket housing a. In consideration of an amount of expansion and contraction, exerted force of the coil spring and the like, the length of the coil spring cannot freely be reduced. Consequently, the electric bulb has its limit when the length of the socket housing a is reduced for the purpose of rendering the electric bulb small. Accordingly, the bulb socket is compelled to project rearwardly to a considerable degree when mounted on the panel P. Thus, the reduction in the length of the bulb socket has been desired.

SUMMARY OF THE INVENTION

Therefore, an object of the present invention is to provide an electric bulb socket having a reduced length.

To achieve the object, the present invention provides an electric bulb socket into which an electric bulb having an electrode on the bottom of a cylindrical base thereof can be inserted. The electric bulb socket comprises a generally cylindrical socket housing having an open end through which the base of the electric bulb is inserted thereinto and a bottom. A spring support is accommodated in the socket housing so as to face the bottom of the base of the electric bulb. The spring support has an electric supply side electrode abutting against the electrode of the electric bulb. A spring member is provided in the socket housing so as to be located outside the spring support. The spring member urges the spring support so that the same is raised toward the open end of the socket housing. A force raising the spring support may be obtained either when the contracted spring member restores to its original state or when the expanded spring member restores to its original state.

According to the above-described construction, the spring member disposed outside the spring support raises the spring support toward the open end of the socket housing. The spring member is thus disposed in the socket housing to be parallel to the base of the electric bulb inserted into the socket housing. Consequently, since the spring member need not be disposed in series to the base of the electric bulb, the length of the socket housing and accordingly, that of the bulb socket can be reduced.

Another object of the present invention is to provide an electric bulb socket which has a simplified construction.

To achieve the object, the present invention provides an electric bulb socket wherein the spring support comprises a bottom plate facing the bottom of the base of the electric bulb and an arm extending from the peripheral edge of the bottom plate toward the open end of the socket housing through the outside of the base of the electric bulb and wherein the spring member is disposed to be parallel to the arm of the spring support and has one of two ends abutting against the bottom of the socket housing and the other end connected to an end of the arm.

According to the above-described construction, the spring member disposed outside the arm of the spring support thrusts the end of the arm out of the inner interior of the socket housing such that the bottom plate accommodated in the inner interior of the socket housing is moved toward the open end of the socket housing. Consequently, the construction of the electric bulb socket can be simplified.

Further another object of the present invention is to provide an electric bulb socket wherein the construction thereof can be simplified and attachment of the electric bulb thereto can be simplified.

To achieve the object, the present invention provides an electric bulb socket wherein the socket housing has a double wall construction with inner and outer cylindrical walls and the spring member comprises a coil spring, wherein the coil spring is disposed inside the outer wall of the socket housing and the bottom plate of the spring support is disposed inside the inner wall of the socket housing, and wherein the arm of the spring support extends outside the inner wall of the socket housing so as to be connected to the end of the coil spring at the open end side of the socket housing.

According to the above-described construction, the coil spring is accommodated in the socket housing to be disposed inside the outer wall, and the bottom plate of the spring support is accommodated in the socket housing to be disposed inside the inner wall. Simultaneously, the arm is connected to the end of the coil spring at the open end side. Thus, the bulb socket has a simplified construction and the attaching work can be simplified.

Further another object of the present invention is to provide an electric bulb socket wherein electrical connection work can be simplified the size of the socket reduced.

To achieve the object, the present invention provides an electric bulb socket wherein the electric supply side electrode has an end extending through the bottom of the socket housing and further comprising a terminal housing accommodating a terminal covering the extending end of the electric supply side electrode and connected to the same.

According to the above-described construction, the terminal is fitted with and connected to the electric supply side electrode extending through the bottom of the socket housing when inserted into the terminal housing formed at the underside of the socket housing. Since the wiring need not be provided in the socket housing, the electrical connection work can be simplified. Furthermore, since the electrode extending through the bottom of the socket housing is fitted with the terminal, the size of the electric bulb socket can be reduced.

Further another object of the present invention is to provide an electric bulb socket which has another simplified construction.

To achieve the object, the present invention provides an electric bulb socket wherein the electric supply side electrode has a terminal section extending toward the bottom of the socket housing, and the socket housing has a through hole formed in the bottom thereof so that the terminal section of the electric supply side electrode extends through the through hole to the terminal housing side.

According to the above-described construction, the terminal section of the electric supply side electrode extends through the through hole into the terminal housing. When inserted into the terminal housing, the terminal can easily be fitted with and connected to the terminal section of the electric power supply side electrode. Thus, the construction of the electric bulb socket can be simplified.

Further another object of the present invention is to provide an electric bulb socket wherein the length of the socket housing can be reduced.

To achieve the object, the present invention provides an electric bulb wherein the terminal housing is disposed across the direction in which the base of the electric bulb is inserted into the socket housing through the open end of the same.

According to the above-described construct ion, an electric wire connected through the terminal extends out in the direction in which the base of the electric bulb is inserted into the socket housing. Consequently, the length of the socket housing can be reduced.

BRIEF DESCRIPTION OF THE DRAWINGS

Other objects, features and advantages of the present invention will become clear upon reviewing the following description of the preferred embodiment, made with reference to the accompanying drawings, in which.

DESCRIPTION OF THE PREFERRED EMBODIMENTS

Figure 2:
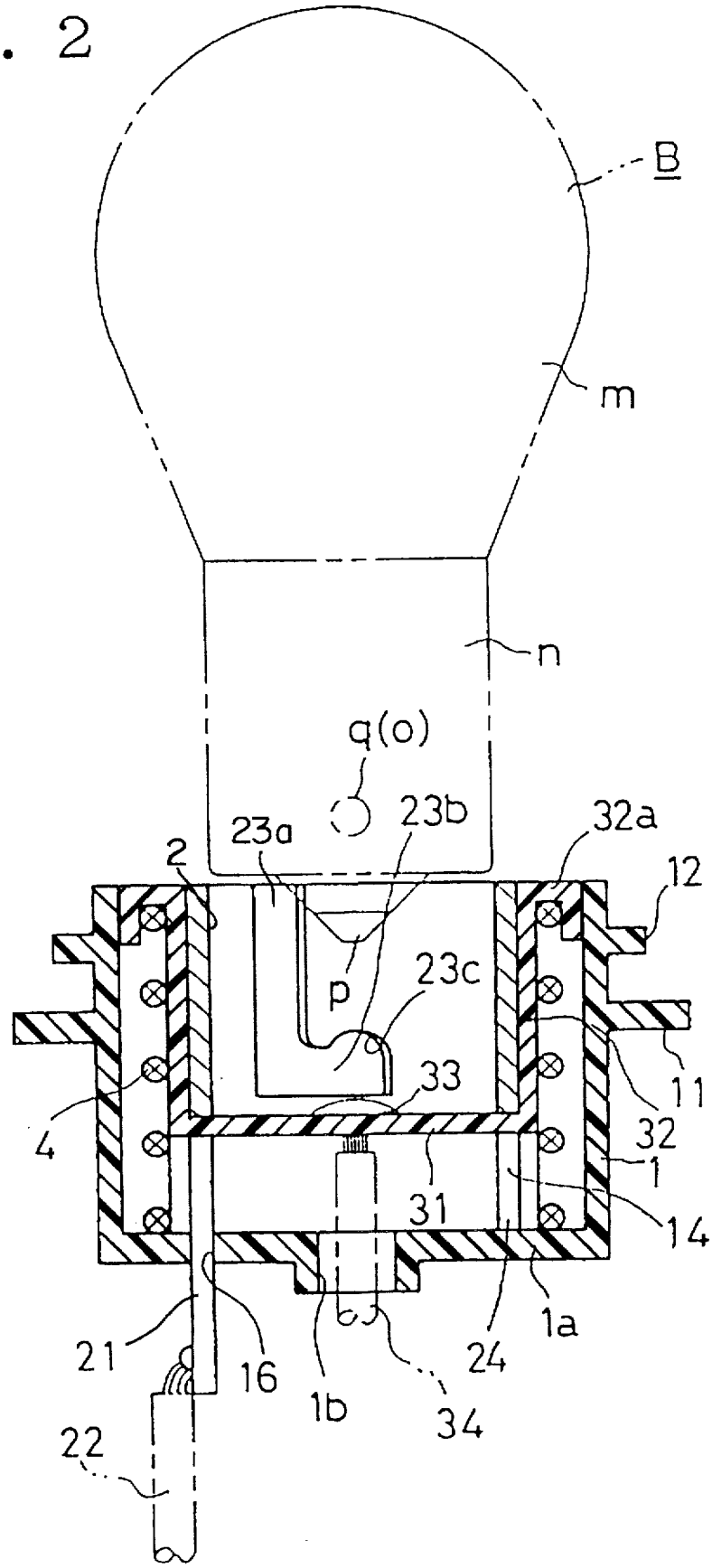
FIG. 2 is a longitudinal sectional view of the electric bulb socket.
Figure 3:
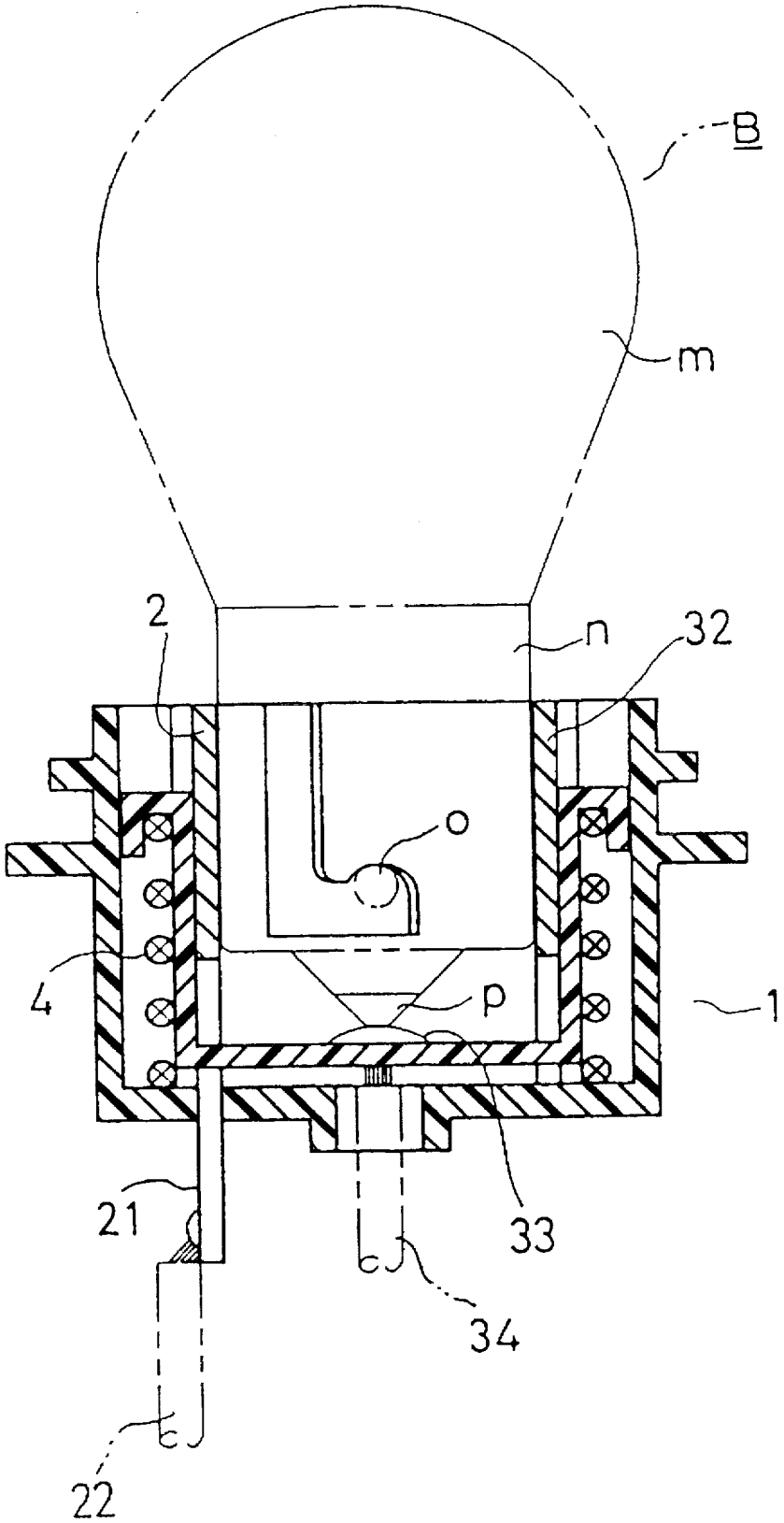
FIG. 3 is a longitudinal sectional view of the electric bulb socket of the first embodiment to which an electric bulb has been attached.

A first embodiment of the present invention will be described with reference to FIGS. 1 to 3. In the first embodiment, an electric bulb B attached to an electric bulb socket in accordance with the present invention comprises a bulb section m, and a base n as described in the description of the prior art. The entire peripheral side of the base n serves as a side electrode o, and a bottom electrode p is provided on the bottom of the base n. Mounting protrusions q also are formed on the peripheral side of the base n. The mounting protrusions q electrically serve as the side electrode o.

Figure 1:
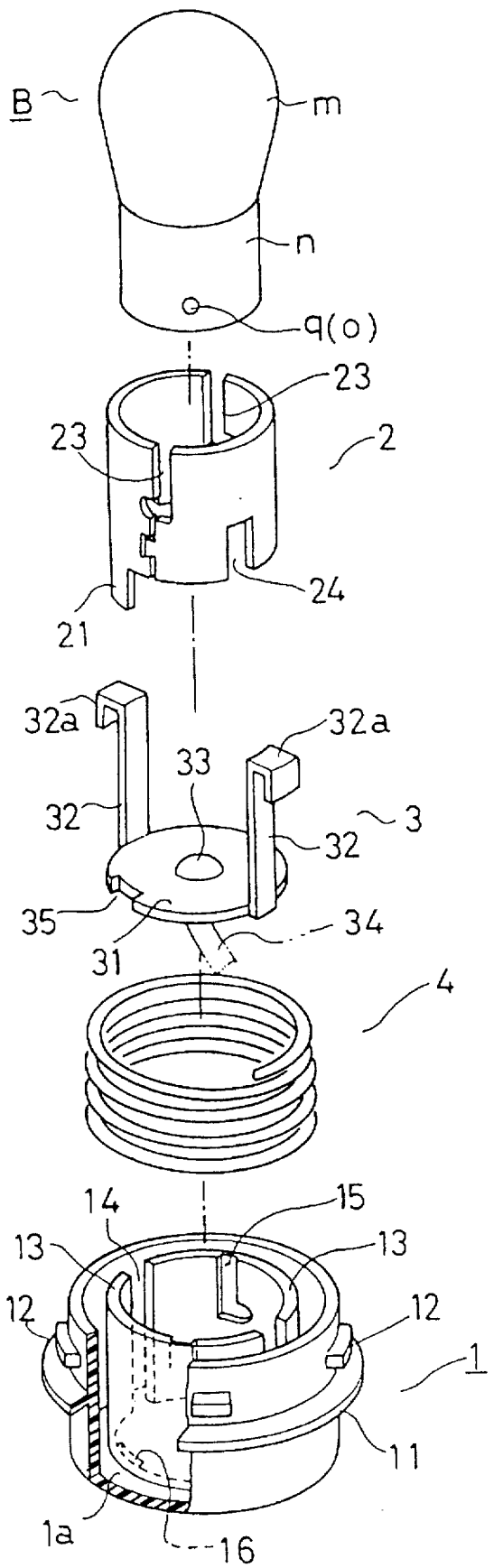
FIG. 1 is an exploded perspective view of a first embodiment of an electric bulb socket in accordance with the present invention.

Referring to FIG. 1, the bulb socket of the first embodiment comprises a socket housing 1 formed of hard plastic, a holder 2, press fitted into the socket housing 1, a spring support 3 held by the holder 2 and a coil spring 4 serving as spring member urging the spring support 3.

The socket housing 1 is generally formed into a cylindrical shape and has an open end and a bottom. The socket housing 1 has a flange 11 and a plurality of engagement protrusions 12 both formed on the outer periphery thereof. The flange extends over the whole periphery of the socket housing 1. The protrusions 12 are opposite to the flange 11. A sealing member is applied to a mounting face of the flange 11 and then, the protrusions 12 are inserted into respective notches of a mounting hole formed in a panel of a lamp house (not shown). Subsequently, the bulb socket is turned by a predetermined angle so that the panel is held between the flange 11 and the protrusions 12, whereby the bulb socket is mounted on the panel of the lamp house.

Two concentric guide walls 13 are formed on the bottom face la of the socket housing 1. Two slits 14 in which spring holding pieces 32 of the spring support 3 are disposed as will be described later are defined between the guide walls 13. Each guide wall 13 has a generally J-shaped mounting groove 15 formed in the inner periphery thereof. The mounting grooves 15 receive the distal ends of the mounting protrusions q formed on the base n of the electric bulb B when the protrusions q are engaged with J-shaped slots 23 as will be described later, respectively.

The coil spring 4 is disposed around the guide walls 13. The spring support 3 is inserted into the socket housing 1 from above the coil spring 4. Subsequently, the holder 2 is secured to the spring support 3 as shown FIG. 2.

The holder 2 is formed of an electrically conductive plate such as a copper plate into a cylindrical shape. The copper plate is curved so that both ends thereof are slightly away from each other. The holder 2 is secured in position by utilizing its expanding force resulting from reduction in the diameter of its curved face when force fitted inside the guide walls 13. Each of the J-shaped slots 23 formed in the holder 2 has approximately the same shape as each of the mounting grooves 15 of the respective guide walls 13. Each J-shaped slot 23 includes an insertion groove **23*a* extending axially from the upper end of the holder 2 and an engagement groove 23*b* peripherally curved approximately at a right angle to the insertion groove 23*a*. The engagement groove 23*b* includes a holding portion 23*c* formed at its termination end to be curved upwardly into the shape of a hook. The holding portion 23*c* of each J-shaped slot 23** holds the protrusion q and also serves as a contact section of the holder 2 serving as a side terminal in contact with the protrusion q which is electrically a side electrode o.

A fixed terminal piece 21 extends downwardly from the lower end of the holder 2. The fixed terminal piece 21 further extends outside the socket housing 1 through a through hole 16 formed in the bottom face 1*a* of the socket housing 1. An electric supply line 22 is brazed to the extended end of the fixed terminal piece 21. Two grooves 24 one of which is shown extend axially from the lower peripheral edge of the holder 2 approximately to the middle of the periphery thereof. The holder 2 is force fitted into the socket housing 1 so that the spring support 3 is vertically movable in the grooves 24. Furthermore.,the holder 2 is secured to the guide walls 13 so that the grooves 24 overlap the respective slits 14 and the J-shaped slots 23 overlap the respective mounting grooves 15.

The spring support 3 formed of an electrically insulating resin includes a disc-shaped bottom plate 31 movable inside the holder 2 and two spring support pieces or arms 32 extending upwardly from the outer peripheral edge of the bottom plate 31 to be opposite to each other. The arms 32 are located in the respective slits 14 defined between the guide walls 13. The upper end of each spring support arm 32 is bent outwardly to thereby serve as a supporting section 32*a*. Each supporting section 32*a* pushes the upper end of the coil spring 4. Accordingly, the upper and lower ends of the coil spring 4 are abutted against and supported by the bottom face la and the supporting sections 32*a* respectively, so that the coil spring 4 urges the spring support 3 toward the open end of the socket housing 1. Accordingly, the spring support 3 is disposed so as to be abutted against the upper ends of the grooves 24. Since the coil spring 4 has a length approximately the same as that of the socket housing 1, as shown in FIG. 2, it urges the spring support 3 with sufficient spring force.

A bottom terminal or an electric supply side electrode 33 is secured on the center of the bottom plate 31 of the spring support 3 by means of caulking. An electric supply line 34 extends into the socket housing 1 through a hole 1*b* formed in the central bottom 1*a* of the same. The extended end of the supply line 34 is connected to the bottom terminal 33 at the underside of the bottom plate 31. The bottom plate 31 has a notch 35 formed in the outer peripheral end thereof. The above-described fixed terminal piece 21 extends through the notch 35 outside the socket housing 1.

When the electric bulb B is attached to the above-described bulb socket, the protrusions q of the bulb B are inserted into the J-shaped slots 23 of the holder 2 and then, into the mounting grooves 15 of the guide walls 13 so that protrusions q reaches the engagement grooves 23*b* via the insertion grooves 23*a*, respectively. Subsequently, the electric bulb B is turned such that the protrusions q are held in the holding portions 23*c*, respectively. On this occasion, the bottom electrode p projecting from the central underside of the base n of the electric bulb B thrusts the bottom terminal 33 of the spring support 3 downwardly against an urging force exerted by the coil spring 4. Consequently, the electric bulb B assumes the position as shown in FIG. 3 with the protrusions q being held in the respective holding portions 23*c*. The bottom electrode p is brought into contact with the bottom terminal 33 with the spring support 3 being urged by the coil spring 4. Furthermore, the protrusions q held in the respective holding portions 23*c* are brought into contact with the holder 2 serving as the side terminal.

According to the above-described embodiment, when the electric bulb B has been attached to the socket housing 1, the bottom electrode p provided on the underside of the base n of the electric bulb B is disposed in the vicinity of the bottom face 1*a* of the socket housing 1 and the coil spring 4 is disposed in parallel to the base n of the bulb B around the same. Consequently, a necessary length of the coil spring 4 can be ensured and the length of the socket housing 1 can be rendered shorter than that of the prior art socket housing.

FIGS. 4 to 7 illustrate a second embodiment of the present invention. In the second embodiment, the invention is applied to a connector type electric bulb socket a connector type.

Figure 4:
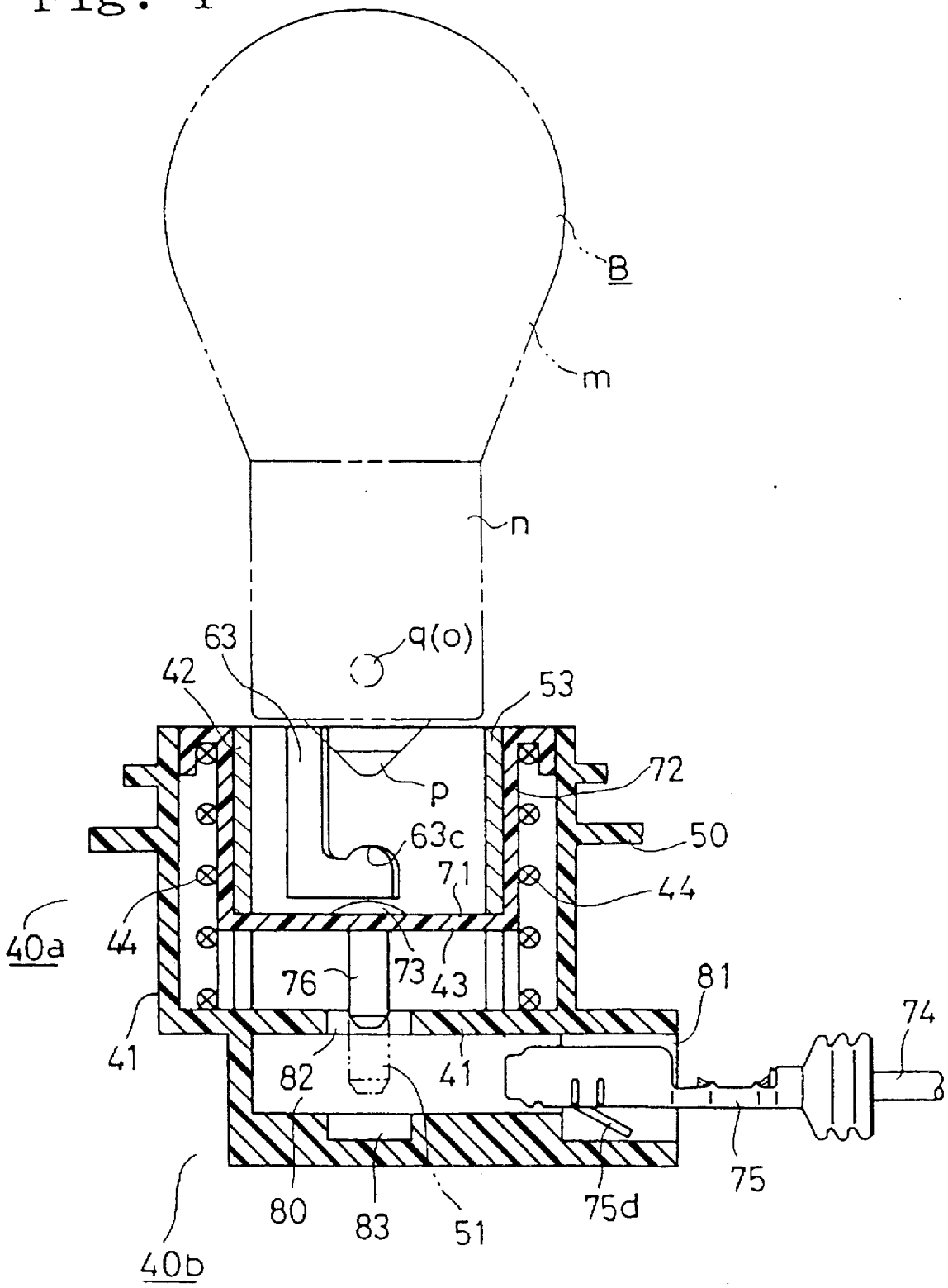
FIG. 4 is a longitudinal sectional view of a second embodiment of an electric bulb socket in accordance with the present invention.

Referring to FIG. 4, the electric bulb socket comprises a socket housing 40*a* formed of the hard plastic and a terminal housing or connector housing 40*b* integrally formed on the underside of the socket housing 40*a*. Since each of the socket housing 40*a*, the holder 42, the spring support 43 and the coil spring 44 has the same construction as in the foregoing embodiment, these parts will not be described. The difference between the first and second embodiments will be described.

The cylindrical bottomed socket housing 40*a* has a partition wall 41 dividing the connector housing 40*b* from the socket housing 40*a*. The connector housing 40*b* includes a terminal accommodating chamber 80 for accommodating a female terminal 75 crimped to one end of one electric supply line 74 and another terminal accommodating chamber (not shown) for accommodating a female terminal crimped to one end of the other electric supply line. These chambers are disposed in parallel with each other. The two chambers have the same construction and the terminals accommodated in the respective chambers also have the same construction. Accordingly, the chamber 80 and the terminal 75 will be described with reference to FIGS. 4, 6 and 7. The terminal accommodating chamber 80 is disposed across the direction in which the electric bulb B is inserted into the socket housing 40*a*, so that the terminal 75 is inserted there into through an entrance portion 81 from the right-hand side to the left-hand side, as viewed in FIG. 4. The entrance portion 81 has a generally circular section and is formed into a generally square cylindrical shape. The partition wall 41 defining the top of the chamber 80 has a communicating hole 82 formed therethrough. A male tab 76 invades the chamber 80 through the communicating hole 82. The chamber 80 has an engagement concavity 83 formed in the bottom thereof.

Figure 6:
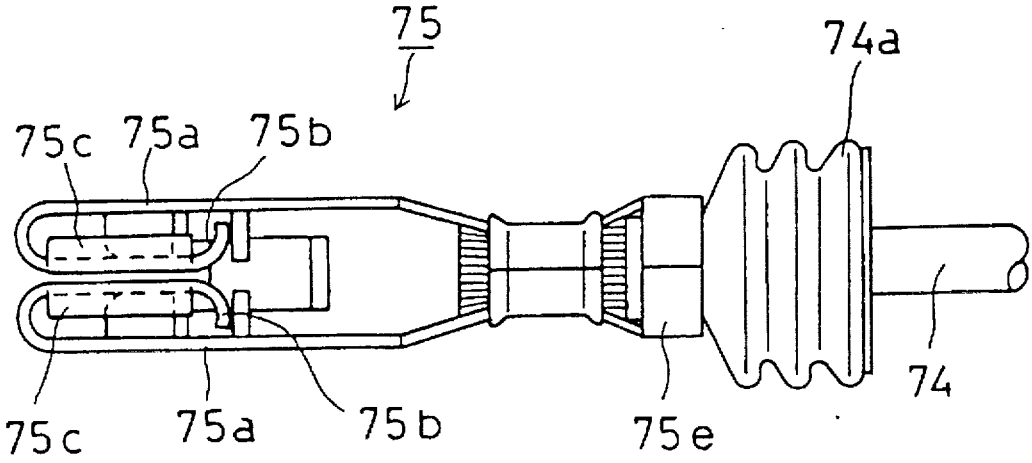
FIG. 6 is a plan view of a terminal employed in the electric bulb socket.
Figure 7:
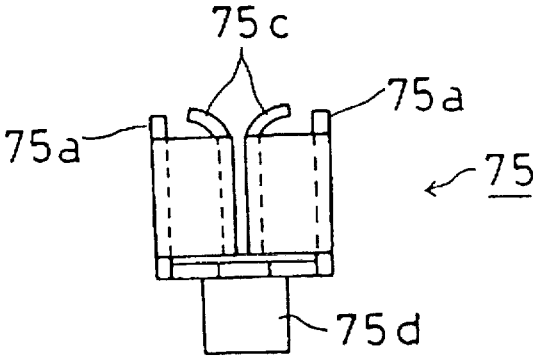
FIG. 7 is a front view of the terminal.
Figure 8:
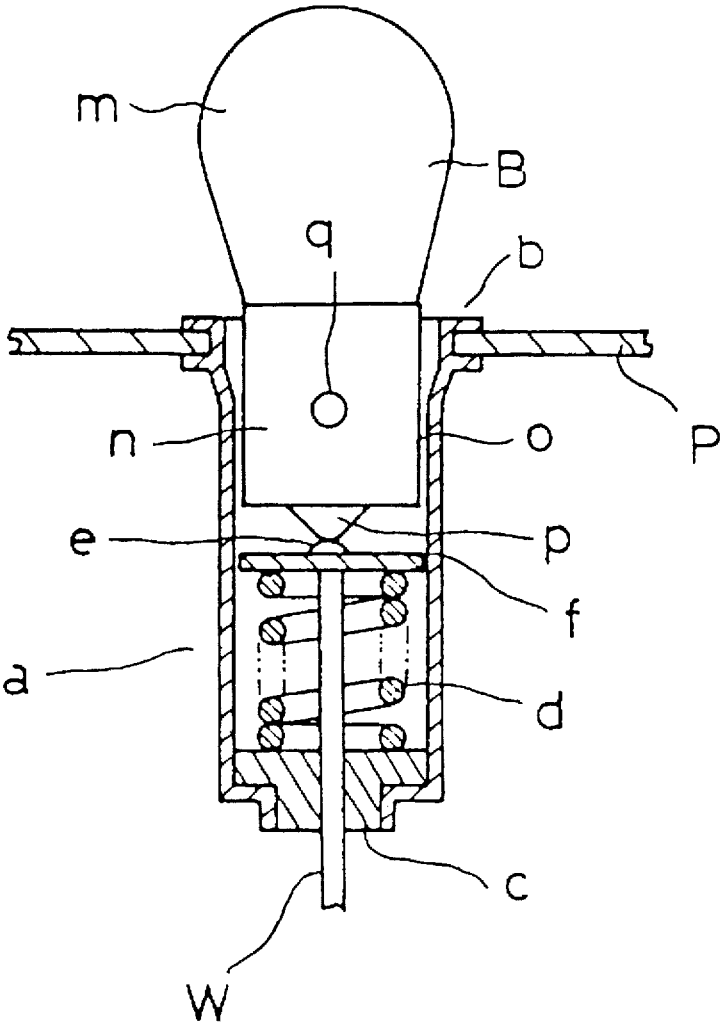
FIG. 8 is a sectional view of a prior art electric bulb socket.

Referring to FIGS. 6 and 7, the terminal 75 is formed by bending a metal plate. Both sides of the terminal 75 are raised to serve as side pieces 75*a*. One ends of each of the side pieces 75*a* is folded inwardly into a U-shape, thereby serving as a contact piece 75*b*. The male tab 76 is resiliently brought into contact with the contact pieces 75*b* to thereby be held between them. Each contact piece 75*b* has a guide piece 75*c* formed by bending its upper portion outwardly. The guide pieces 75*c* guide the male tab 76 in between the contact pieces 75*b* when the male tab 76 is inserted from above. The terminal 75 has a resilent engagement piece 75*d* projecting from the bottom thereof. The resilient engagement piece 75*d* is resiliently deformed when the terminal 75 is inserted into the terminal accommodating chamber 80. The engagement piece 75*d* is engaged with the concavity 83 so that the terminal 75 can be prevented from falling out of the chamber 80. The base of the terminal 75 includes a crimping portion 75*e* to which a sheath and an exposed conductor of the electric supply line 74 are crimped, so that the terminal 75 is fixed to the end of the electric supply line 74. A resilient seal ring 74*a* formed of rubber is fitted with the power supply line 74. The seal ring 74*a* seals the entrance portion 81 of the terminal accommodating chamber 80 to thereby make it waterproof.

Returning to FIG. 4, the coil spring 44 is disposed around the guide walls 53 of the socket housing 40*a* as in the foregoing embodiment. The spring support 43 is inserted into the socket housing 40*a* from above the coil spring 44 and then, the holder 42 is fixed to the guide walls 53. The holder 42 serving as the side terminal has a fixed terminal piece 51 projecting from the underside thereof. When the electric bulb has been attached to the bulb socket, the fixed terminal piece 51 invades the terminal accommodating chamber (not shown) at the electrode side from above, as shown by broken lines in FIG. 4.

The spring support 43 is formed of the electrically insulating resin as in the foregoing embodiment. The spring support 43 comprises a disc-shaped bottom plate 71 and two spring support arms 72. A bottom terminal 73 is provided on the bottom plate 71 and includes at the underside of the bottom plate 71 the above-described male tab 76 projecting downwardly so that it corresponds to the above-described communicating hole 82.

Figure 5:
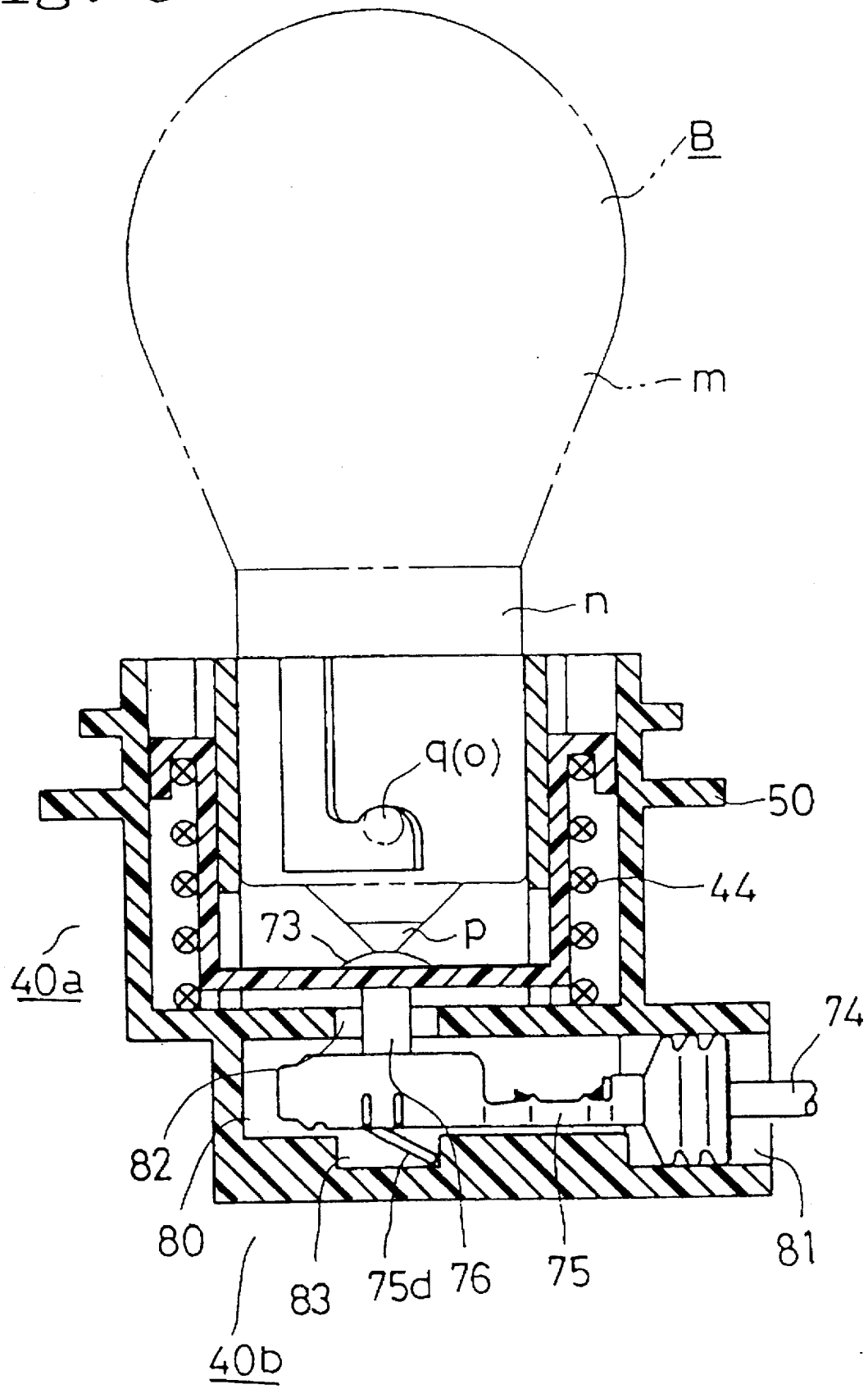
FIG. 5 is a longitudinal sectional view of the electric bulb socket of the second embodiment to which an electric bulb has been attached.

When the electric bulb B is attached to the above-described bulb socket.,the protrusions q formed on the base n of the electric bulb B are inserted into the J-shaped slots 63 to be held in the holding portions 63*c*, respectively. The bottom electrode p projecting from the central bottom of the base n thrusts the bottom terminal 73 of the spring support 43 against the urging force exerted by the coil spring 44, thereby assuming the position as shown in FIG. 5. Consequently, the bottom electrode p of the electric bulb B urged by the coil spring 44 is brought into contact with the bottom terminal 73. Furthermore, the protrusions q (the side electrode o) of the base n of the electric bulb B are engaged with the holding portions 63*c* of the J-shaped slots 63 respectively such that the protrusions q are brought into contact with the holder 42 serving as the side terminal. Additionally, the male tab 76 of the bottom terminal 73 invades the terminal accommodating chamber 80 through the communicating hole 82. Then, the sealing member is applied to the mounting face of the flange 50 and then, the bulb socket to which the electric bulb is attached is mounted on the panel of the lamp house in the same manner as in the foregoing embodiment.

Subsequently, when the terminals 75 are inserted into the terminal accommodating chambers 80, respectively, the male tab 76 is held between the contact pieces 75*b* such that the male tab 76 is electrically connected to the electric supply line 74.

As described above, the terminal 75 is provided with the guide pieces 75*c* guiding the male tab 76 in between the contact pieces 75*b*. Accordingly, the terminal 75 may be inserted into the terminal accommodating chamber 80 before attachment of the electric bulb B to the bulb socket and thereafter, the electric bulb B may be attached to the socket housing 40*a*.

According to the second embodiment, when the electric bulb B has been attached to the socket housing 40*a*, the bottom electrode provided on the underside of the base n of the electric bulb B is disposed in the vicinity of the partition wall 41 defining the bottom of the socket housing 40*a* and the coil spring 44 is disposed in parallel to the base n of the bulb B around the same. Consequently, a necessary length of the coil spring 4 can be ensured and the length of the socket housing 1 can be rendered shorter than that of the prior art socket housing.

Furthermore, the terminal accommodating chamber 80 is disposed across the direction in which the electric bulb B is inserted into the socket housing 40*a*. Consequently, the length of the socket housing 40*a* can be rendered shorter in spite of the provision of the connector housing 40*b*.

The foregoing disclosure and drawings are merely illustrative of the principles of the present invent ion and are not to be construed in a limiting sense. Various changes and modifications will become apparent to those of ordinary skill in the art. All such changes and modifications are seen to fall within the true spirit and scope of the invention as defined by the appended claims.

We claim:

1. An electric bulb socket to which an electric bulb having an electrode on the bottom of a cylindrical base thereof is attached, the electric bulb socket comprising:

a generally cylindrical socket housing having an open end through which the base of the electric bulb is inserted thereinto, and a bottom;

a spring support accommodated in the socket housing so as to face the bottom of the base of the electric bulb, the spring support having an electric supply side electrode against which the electrode of the electric bulb abuts when the base of the electric bulb is inserted in the socket housing;

a spring member provided in the socket housing so as to be located outside the spring support, the spring member urging the spring support so that the spring support is raised toward the open end of the socket housing;

wherein the spring support comprises a bottom plate facing the bottom of the base of the electric bulb and an arm extending from the peripheral edge of the bottom plate toward the open end of the socket housing; and wherein the spring member is disposed to be parallel to the arm of the spring support and has one of two ends abutting against the bottom of the socket housing and the other end connected to an end of the arm.

2. An electric bulb socket according to claim 1, wherein the socket housing has a double wall construction with inner and outer cylindrical walls and the spring member comprises a coil spring, wherein the coil spring is disposed inside the outer wall of the socket housing and the bottom plate of the spring support is disposed inside the inner wall of the socket housing, and wherein the arm of the spring support extends outside the inner wall of the socket housing so as to be connected to the end of the coil spring at the open end side of the socket housing.

3. An electric bulb socket according to claim 1, wherein the electric supply side electrode has an end extending through the bottom of the socket housing, and wherein a terminal housing is mounted to the socket housing for accommodating a terminal therein.

4. An electric bulb socket according to claim 3, wherein the electric supply side electrode has a terminal section extending toward the bottom of the socket housing, and the socket housing has a through hole formed in the bottom thereof so that the terminal section of the electric supply side electrode extends through the through hole and into the terminal housing.

5. An electric bulb socket according to claim 3, wherein the terminal housing is disposed normal to a direction in which the base of the electric bulb is inserted into the socket housing through the open end thereof.

* * * * *